United States Patent [19]

Schwadike et al.

[11] 4,236,320

[45] Dec. 2, 1980

[54] METHOD AND APPARATUS FOR CONDITIONING AND DRYING LAUNDRY

[75] Inventors: Karl Schwadike, Leverkusen; Dieter Meyer, Düsseldorf; Rolf Puchta, Haan, all of Fed. Rep. of Germany

[73] Assignee: Henkel Kommanditgesellschaft auf Aktien (Henkel KGaA), Dusseldorf-Holthausen, Fed. Rep. of Germany

[21] Appl. No.: 41,698

[22] Filed: May 23, 1979

[30] Foreign Application Priority Data

May 29, 1978 [DE] Fed. Rep. of Germany ..... 2823351

[51] Int. Cl.[3] ..... F26B 3/04; D06B 1/02

[52] U.S. Cl. ..... 34/19; 34/60; 34/133; 68/20; 68/205 R

[58] Field of Search ..... 34/45, 54, 60, 68, 133, 34/139, 9, 19; 68/20, 205 R; 159/45 R

[56] References Cited

U.S. PATENT DOCUMENTS

| | | | |
|---|---|---|---|
| 2,851,791 | 9/1958 | Olthuis | 68/20 X |
| 3,022,580 | 2/1962 | Duty | 68/205 R X |
| 3,114,653 | 12/1963 | Kruzan | 68/20 X |
| 3,180,037 | 4/1965 | Kenreich et al. | 68/20 X |
| 3,364,585 | 1/1968 | Fish et al. | 34/60 X |
| 3,401,052 | 9/1968 | Berger et al. | 68/20 X |
| 3,583,180 | 6/1971 | Arbogast | 68/20 X |
| 3,872,604 | 3/1975 | Keller | 34/133 X |

*Primary Examiner*—Lloyd L. King
*Assistant Examiner*—Harold Joyce
*Attorney, Agent, or Firm*—Hammond & Littell, Weissenberger and Muserlian

[57] ABSTRACT

The invention is directed to a method of simultaneously conditioning and drying laundry, as well as an apparatus therefor. According to the invention, laundry in an automatic clothes drier is periodically sprayed with fabric softeners and conditioners from a spraying device in the drier drum when the drum is stopped so that the spraying device is located above the laundry.

13 Claims, 2 Drawing Figures

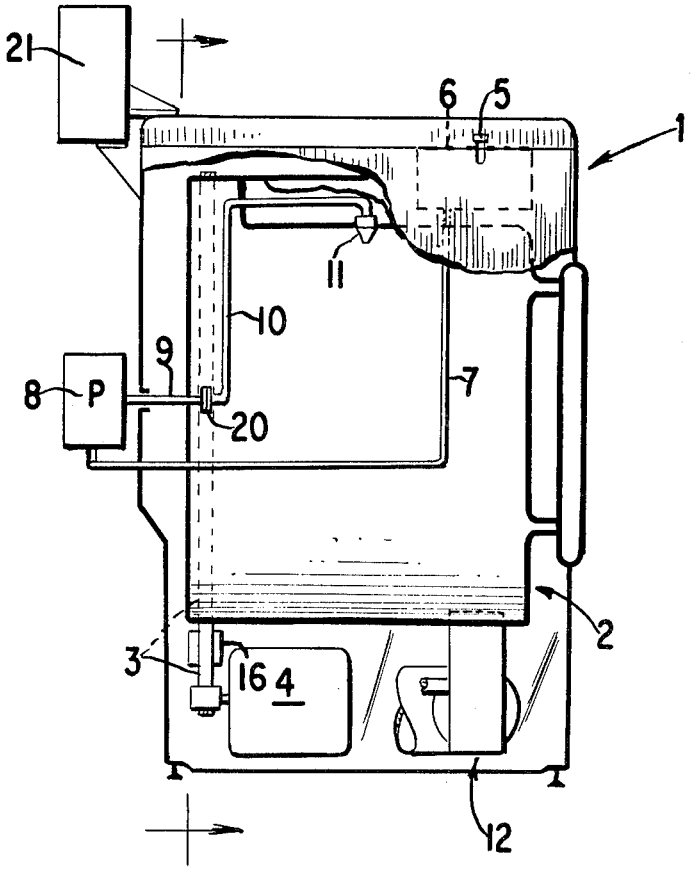
FIG. 1
FIG. 2
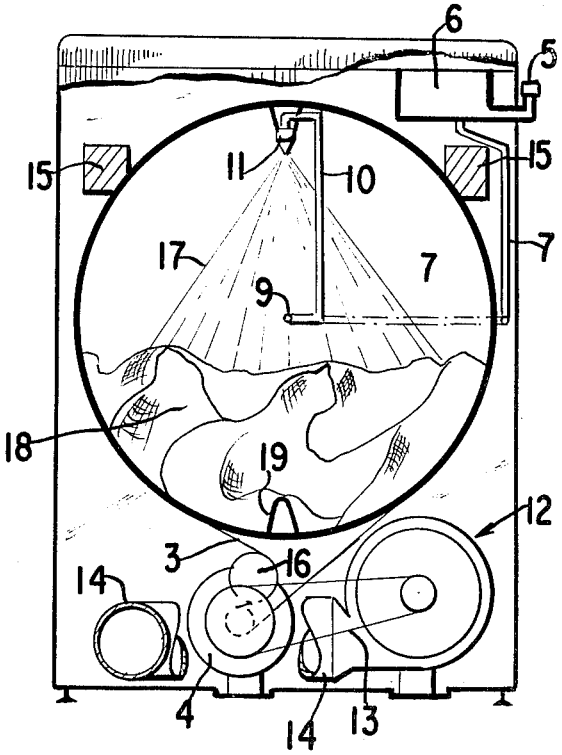

METHOD AND APPARATUS FOR CONDITIONING AND DRYING LAUNDRY

FIELD OF THE INVENTION

This invention is directed to the drying and conditioning of laundry. More particularly, this invention is directed to the simultaneous drying and conditioning of laundry in an automatic clothes drier.

BACKGROUND OF THE INVENTION

In many instances washed fabrics have undesirable properties, such as, for example, inadequate softness, low fluffiness, electrostatic charge, etc. It is often desirable to impart to the fabrics advantageous properties by treatment after washing, such as by adding liquid agents to the rinsing bath after the washing process. To be suitable for this after-treatment, these liquid agents must not only spread evenly in the cold rinsing liquor but they must also be absorbed in a short time from the liquor onto the fabrics. Suitable products are on the market which impart to fabrics desired properties, mostly softening and antistatic properties, when they are added to the last rinsing both. However, all pieces in the wash are affected uniformly by this type of treatment, which means that the laundry must be sorted before washing in view of this after-treatment. In addition, care must be taken in this method so that the after-treatment agent is put into the washing machine at the right time without direct contact with detergent.

Another disadvantage of the known after-treatment agents is that since pourability and rapid distribution in cold rinsing water are only ensured if the active substances are present in a 10 to 20-fold dilution, they can only be produced as highly diluted aqueous suspensions. This leads to relatively high costs for packing and transportation. Substances which are insoluble in cold water are unsuitable for this type of treatment, as are those substances which have no specific affinity to the fabric surface and therefore are lost with the spent rinsing water. Thus, the number of usable active substances is limited.

Use of an automatic drier saves time and space, as compared to hanging wash on a wash-line. In view of constantly increasing use of automatic driers, both commercially and in private households, there are new possibilities with regard to placing after-treatment agents into the drier and effecting the conditioning together with the drying of the wash. By after-treatment in the drier, it is possible also to control unpleasant properties of the laundry which appear only during the drying in the drier, such as an undesired damp odor of the wash, particularly when the driers are operated with ambient air, as well as electrostatic charge of the dry wash.

A number of suggestions have been made as to how to apply known and new active substances in the after-treatment in the drier. These suggestions concern substantially the use of sheet-type or compact absorbent substrates which are impregnated with active substance, and of foaming or non-foaming aerosol mixtures with which active substance is sprayed on the inner wall of the drier or on the damp laundry pieces. Furthermore, it has been proposed to use perforated hollow bodies which contain a solution or paste of active substance and which are moved in the drier together with the wash, as well as to use solid, lumpy mixtures of active substances with soluble carriers which are to be absorbed on the fabric surface during the drying process.

These forms of application have, however, a number of drawbacks. The use of solid fabric softeners results in an irregular distribution and, thus, spots on the laundry. With regard to the perforated hollow bodies filled with liquid after-treatment agents, the problem of the regular distribution of the active substances has not been solved either. Other drawbacks are the difficulties in handling these bodies and of controlling the dissemination of the active substances. When these preparations are used in spray form, undesired deposits are frequently formed on the parts of the device which are important for the operation of the drier, such as the temperature and humidity sensors. Furthermore, with regard to substrates formed of paper or woven or non-woven fabrics, the active substance adhering to the substrates, which is supposed to detach itself from the substrate and attach itself to the drying fabric, is given off incompletely and irregularly due to the fact that the substrates, which have large surface areas, stick to the wall of the drier or the laundry pieces. The preparations containing active substances on these compact substrates having large surface areas, must, in addition, be produced in expensive packages to avoid loss of volatile substances, particularly perfumes, until they are used. The loss of volatile substances during the automatic drying process is significant, just as with liquid preparations added during the rinsing process, because the preparations are added at the start of the process and then exposed during the entire drying process to the action of the hot drying air.

It has been suggested in DOS No. 23 18 596 that solutions or emulsions of after-treatment agents be sprayed into the automatic drier drum during drying, after a certain degree of dryness has been attained. This method avoids excessive losses of volatile substances; however, it has the disadvantage that, at the time of spraying, some laundry pieces are only a short distance from the nozzle and are hit by a concentrated jet of the after-treatment preparation. This leads to spots on the laundry and to irregular distribution of the active substances.

Applicants have found that these disadvantages can be overcome by spraying from a spray mechanism located at the top of the drum, as is explained more fully below.

OBJECTS OF THE INVENTION

It is an object of this invention to provide an improved method and apparatus for simultaneously conditioning and drying laundry.

It is also an object of this invention to provide a method of simultaneously conditioning and drying laundry whereby the conditioning preparations are uniformly dispersed.

BRIEF DESCRIPTION OF THE DRAWINGS

FIG. 1 represents a lateral view of an embodiment of the invention;

FIG. 2 represents a rear, cross-sectional view of that embodiment.

DETAILED DESCRIPTION OF THE INVENTION

This invention is directed to a method and apparatus for simultaneously conditioning and drying laundry in an automatic clothes drier.

According to the invention, a liquid conditioner is sprayed from a storage vessel into the drier drum during the drying process, which consists of moving and standstill phases, under the action of hot air onto the material to be washed. The method is characterized in that conditioner is sprayed at least during a part of the standstill phases of the drum from a nozzle arranged inside the drum and rotating with the drum and directed toward the spatial center of the drum. The nozzle is located at the highest point of the drum during the spraying, which ensures a sufficiently great distance between the spray nozzle and the laundry to be treated, so that the conditioners issuing from the spray nozzle hit the laundry pieces in fine distribution.

In order to provide that all laundry pieces are treated uniformly with conditioner, the drying process consists of cycles comprised of moving and standstill phases, the spraying occurring only during the standstill phases. The cycle can be programmed or designed so that a moving phase having a duration of about 20 seconds is followed by a standstill phase of about 5 to 10 seconds. Each standstill phase is followed by another moving phase in the same or opposite direction.

The spraying time within each standstill phase during which spraying occurs, is from about 1 to 10 seconds. During this time, about 0.3 to about 3 ml of conditioner liquid are sprayed.

The number or frequency of sprayings over the duration of the drying process, as well as the commencement and cessation of spraying can be varied. For example, if a weak conditioning effect is desired, the drier controls can be set so that the laundry is only sprayed ten times during the entire drying process. On the other hand, if the conditioning effect is to be stronger, the controls are set so that the laundry is sprayed one hundred times. If the conditioners contain volatile substances, such as perfumes, the sprayings can be effected at the end of the drying process, which may last up to about ninety minutes. The spraying of non-volatile substances, for example, fabric softeners, however, is effected best on the damp wash.

To avoid losses of sprayed conditioners by discharge with the drying air, it is advisable that no air move in the drier drum itself during the spraying. For this reason the hot air should be diverted elsewhere or, preferably, the hot-air fan is disconnected or shut off during the spraying process.

The above setting possibilities facilitate adapting drying and conditioning to provide the greatest possible uniformity of the distribution of the conditioner, as concerns both the type of fabric and the desired intensity of the conditioning.

Basically, all liquid conditioners are suitable for carrying out the method according to the invention. These include, for example, fabric-softening substances; fabric antistatics; antimicrobics; soil release-substances; ironing aids; impregnating-, flame-retarding-, and mothproofing agents; and perfumes, individually or in mixtures, as well as auxiliary substances, if necessary, such as water, solvents, dispersing or emulsifying agents, viscosity standardizing agents or dyes.

Any of the known liquid fabric-softening preparations can be used according to this invention. Particularly useful are the quaternary salts of ammonia and/or of imidazoline, particularly the chloride, bromide, or methyl sulfate salts, preferably with two long-chained aliphatic radicals in the molecule, alone or in combination with a condensation product of 1 mole hardened tallow and 1 mole hydroxyethylethylene diamine in a ratio of about 4:1 to 1:4.

An apparatus suitable for carrying out the method of the invention comprises a conventional automatic clothes drier containing the following additional parts:

(a) a spray nozzle arranged on the inside of the revolving drum substantially in the middle between front and back wall of the drum, which is connected over a feed pipe to a pump and a storage vessel for the liquid conditioner; and (b) a means for controlling the movement of the drum, the spraying process and the hot-air fan, having a programming system to provide that the spray nozzle rotating with the drum and directed toward the spatial center of the drum, is at its highest point during the periodic standstill phase of the drum, and that the conditioner is dispensed in this position, with the hot-air fan disconnected, onto laundry arranged loosely in the bottom part of the drier drum.

The invention can be appreciated best by making reference to the drawings. In the FIG. 1, the automatic clothes drier 1, either gas or electric, has a tumbling drum 2 turned by rubber belt 3 powered by electric motor 4.

Fabric softener and other desired liquid conditioners are poured into opening 5 of storage container 6. They then flow through feed tube 7 to pump 8, and from pump 8 through feed tube 9, and then through nozzle feed tube 10 to spray nozzle 11. Nozzle feed tube 10 is fixed to, and moves in conjunction with, drum 2. Tube 10 can be located either within or without drum 2, preferably within.

During the drying process, the conditioners are pumped by pump 8 from storage container 6 axially into drum 2 via fixed feed pipe 9, and through nozzle feed pipe or tube 10 to spray nozzle 11.

The drier 1 also comprises conventional means for heating and distributing air, such as blower 12, and a control mechanism 21, which comprises means for selecting particular modes of spraying and drying and means for implementing those modes by causing the dryer drum 2 to pause and fabric softener to be sprayed through nozzle 11 as warranted.

The rear, cross-sectional view of FIG. 2 shows that the blower 12, which is turned by belt 13 from motor 4, can blow air into duct 14. Also shown are pressure or inductive contacts 15 which act to slow or stop the drum 2 for spraying, at which time clutch mechanism 16 disengages. The spray nozzle 11 sprays fabric softener and other conditioners over spraying zone 17 onto damp clothes layer 18.

In a preferred embodiment of the invention, the drum 2 contains one or more carrier fins, such as fin 19, and the nozzle 11 is arranged in one of the fins.

The nozzle 11 can comprise, in practice, one or more spraying means or nozzles spaced to provide more even distribution of the conditioners. The tube connection 20 should be constructed to permit the passage of conditioners from fixed feed pipe 9 to nozzle feed pipe 10 without leakage. The nozzle feed pipe 10 can be sealed from the fixed pipe 9 by slide ring packings. In the case of an axial bushing, a rotary bushing is particularly suitable.

To prevent spotting that would result from the conditioner running out or dripping off the nozzle 11 at the end of the spraying process, after the pump has been disconnected, it is advisable to design the nozzle 11 as a pressure-controlled valve which would close the nozzle orifice at a certain pressure lower than the operating pressure of the pump.

EXAMPLES

The following examples are intended to demonstrate the invention and are not to be construed as limiting the invention thereto.

EXAMPLE 1

A commercial automatic clothes drier (Type T 333, available from Miele Company, Germany) was provided with a closable filling hole, accessible from the top, by installing a conditioner storage vessel (capacity 1.5 l) under the cover plate. From this vessel, a line (pressureless) led to a diaphragm feed pump. The conditioner added was pumped by the pump through a pressure line through the center of the back wall of the drum by means of a rotary bushing, and into a spray nozzle designed as a pressure controlled valve, which was arranged in a carrier fin. The spray nozzle opened against a spring force, which must be overcome by the delivery pressure of the pump.

On the outside of the back wall of the pump were two adjustably mounted metal plates. These plates rotated with the drum on two inductive contactors of an additional control circuit. At the end of a moving phase (clockwise or counter-clockwise) of the drum, these metal plates (one each for clockwise and counter-clockwise rotation) started a braking process of the drum, at the end of which the carrier fin with the installed spray nozzle remained at the highest point of the circular movement. At the same time as the braking, the fan for the drying air was also disconnected.

When the drum stopped, the laundry fell into the lower part of the drum, which created a sufficient distance between spray nozzle and laundry to ensure uniform spraying of the laundry. Then the spraying process, which lasted a few seconds, was started by the control circuit turning on the diaphragm feed pump. When the pump was disconnected, the nozzle closed before the drum started to run again.

In the next standstill phase, the process was repeated, and other areas of the laundry were naturally hit by the spray cone.

The control means was provided with actuators on which can be set: the time when the spraying process is to start (e.g., 15 minutes after the start of the drying program); the length of the spraying process (e.g., 20 minutes, in the standstill phases); and the length of one spray (e.g., 3 seconds). This control means could be integrated into the program selector by which the various drying programs are controlled.

EXAMPLE 2

The device described in Example 1 was used for softening laundry pieces by proceeding as follows:

From the start of the drying program (program "normal drying"), an amount of 1.9 ml per spray (total of about 100 ml) of a fabric softener containing 1.8% by weight of a di-(hardened tallow alkyl) dimethylammonium chloride and 1.3% by weight of a 1:1 condensation mixture of hardened tallow and hydroxyethylethylene diamine, in aqueous dispersion, was sprayed on laundry having a dry weight of 2.8 kg ($\frac{1}{3}$ Turkish towels, $\frac{2}{3}$ smooth fabrics). The spraying took place over a period of about 30 minutes during each of the 53 standstill phases, duration of about 8 seconds, following a moving phase of about 20 seconds. The spraying itself lasted about 3 seconds.

The feel of the laundry thus treated was judged by a group of persons experienced in such tests for comparison with (i) laundry wherein the same amount of the fabric softener had been added in the last rinsing cycle and then the laundry had subsequently been tumbler dried and (ii) laundry wherein the same amount of fabric softener had been sprayed continuously in the tumbler on the moving laundry. According to those persons judging, the distribution of fabric-softening substances was much more uniform in the laundry treated according to the method of the invention.

The above procedure was repeated for perfume mixtures applied to the laundry, and similar results were achieved. If the perfumes were applied as aqueous emulsions according to the method of the invention, the odor intensity and, in particular, the uniformity of the perfume distribution were much better than in treatment in the rinsing liquor with subsequent drying in the tumbler or with continuous application on the moving laundry in the tumbler.

The preceding specific embodiments are illustrative of the practice of the invention. It is to be understood, however, that other expedients known to those skilled in the art, or disclosed herein, may be employed without departing from the spirit of the invention or the scope of the appended claims.

We claim:

1. A method for simultaneously conditioning and drying laundry in an automatic clothes drier wherein a liquid conditioner is sprayed from a storage vessel onto laundry in the drum of the drier during a drying process comprising alternating moving and standstill phases, the liquid conditioner being sprayed during at least a part of standstill phases from a nozzle arranged inside the drum and rotating with the drum and directed to the spatial center of the drum, and the nozzle being at the highest point of the drum during the spraying.

2. The method according to claim 1, wherein the liquid conditioner is sprayed during from about 10 to about 100 standstill phases.

3. The method according to claim 1, wherein the spraying during standstill phases lasts from about 1 to 10 seconds in each phase.

4. The method according to claim 1, wherein from about 0.3 to 3 ml of liquid conditioner are sprayed during each second of spraying.

5. The method according to claim 1, wherein no drying air is distributed through the drum during spraying.

6. The method according to claim 1, wherein the liquid conditioner is selected from the group consisting of fabric-softening substances; fabric-antistatics; antimicrobials; soil-release substances; ironing aids; impregnating-, flame-retarding-, and mothproofing substances; perfumes; and mixtures thereof and auxiliary substances.

7. The method according to claim 6, wherein the liquid conditioner is selected from the group consisting of the quaternary ammonium salts of ammonia, of imidazoline, or of both ammonia and imidazoline, with 2 long-chained aliphatic radicals in the molecule, alone or in combination with a condensation product of 1 mole hardened tallow and 1 mole hydroxyethylethylene diamine in a ratio of from about 4:1 to 1:4.

8. An improved apparatus for automatically drying laundry which comprises rotating drum means containing the laundry and means for causing hot air to flow through the drum, wherein the improvement comprises (i) a spraying means arranged on the inside of the drum wall substantially midway between the front and rear walls of the drum, which spraying means is connected by means of a feed pipe to a pump and a storage vessel for liquid conditioner, and (ii) a control means for controlling the rotation of the drum, spraying, and hot air flow, the spraying means revolving with the drum and being directed toward the center of the drum, the drying being comprised of alternating moving and stationary phases, said control means controlling the spraying at the highest point of the drum during the stationary phases, the spraying means spraying liquid conditioner onto laundry lying loosely in the lower part of the drum during stationary phases for a predetermined length of time and in a predetermined quantity, such that the laundry is simultaneously conditioned and dried.

9. An apparatus according to claim 8, wherein the spray means comprises a spray nozzle.

10. An apparatus according to claim 9, wherein the spray nozzle is arranged in a carrier fin secured in the drum.

11. An apparatus according to claim 9, wherein the spray nozzle is equipped with a valve which closes the nozzle orifice when the pump pressure falls below a value necessary for atomization.

12. An apparatus according to claim 11, wherein the feed pipe to the spray nozzle is conducted axially through the back wall of the drum.

13. An apparatus according to claim 9, wherein the part of the feed pipe arranged inside the drum follows the movement of the drum and is sealed by means of a rotary bushing from the non-moving part of the feed pipe arranged outside the drum.

* * * * *

UNITED STATES PATENT AND TRADEMARK OFFICE

CERTIFICATE OF CORRECTION

PATENT NO. : 4,236,320

DATED : December 2, 1980

INVENTOR(S) : KARL SCHWADTKE ET AL.

It is certified that error appears in the above—identified patent and that said Letters Patent is hereby corrected as shown below:

Preamble page, under "[75]", the name of the inventor "Karl Schwadike" should read -- Karl Schwadtke --.

Column 1, line 25: "both" should read -- bath --.

Signed and Sealed this

*Twenty-fifth* Day of *August 1981*

[SEAL]

*Attest:*

GERALD J. MOSSINGHOFF

*Attesting Officer*

*Commissioner of Patents and Trademarks*